US007232503B2

(12) United States Patent
Nurminen et al.

(10) Patent No.: US 7,232,503 B2
(45) Date of Patent: Jun. 19, 2007

(54) METHOD IN INTERNAL SIZING OF LIQUID PACKAGING BOARD AND INTERNAL SIZE

(75) Inventors: Markku Nurminen, Raisio (FI); Kenneth Sundberg, Åbo (FI); Claes Zetter, Åbo (FI)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 248 days.

(21) Appl. No.: 10/474,718

(22) PCT Filed: Apr. 10, 2002

(86) PCT No.: PCT/FI02/00302

§ 371 (c)(1),
(2), (4) Date: Mar. 24, 2004

(87) PCT Pub. No.: WO02/084027

PCT Pub. Date: Oct. 24, 2002

(65) Prior Publication Data

US 2004/0149166 A1 Aug. 5, 2004

(30) Foreign Application Priority Data

Apr. 10, 2001 (FI) ..... 20010737

(51) Int. Cl.

| | |
|---|---|
| ***D21H 17/17*** | (2006.01) |
| ***D21H 21/16*** | (2006.01) |
| ***C07D 305/00*** | (2006.01) |
| ***C07D 305/12*** | (2006.01) |

(52) U.S. Cl. ..... 162/164.1; 162/158; 162/183; 549/327; 525/300

(58) Field of Classification Search ..... 162/164.1, 162/158, 183; 549/327; 525/300
See application file for complete search history.

(56) References Cited

U.S. PATENT DOCUMENTS

| | | | | |
|---|---|---|---|---|
| 5,456,800 | A | 10/1995 | Tansley et al. | 162/158 |
| 5,846,663 | A * | 12/1998 | Brungardt et al. | 428/537.5 |
| 5,853,542 | A * | 12/1998 | Bottorff | 162/168.2 |
| 6,007,906 | A * | 12/1999 | Bottorff et al. | 428/323 |
| 6,048,392 | A | 4/2000 | Brungardt et al. | 106/287.21 |
| 6,074,529 | A | 6/2000 | Lindgren et al. | 162/158 |
| 6,123,760 | A * | 9/2000 | Varnell | 106/174.1 |
| 6,175,022 | B1 * | 1/2001 | Brungardt et al. | 549/510 |
| 6,207,258 | B1 * | 3/2001 | Varnell | 428/32.1 |
| 2001/0009180 | A1 * | 7/2001 | Welch et al. | 162/158 |

FOREIGN PATENT DOCUMENTS

| | | | |
|---|---|---|---|
| WO | WO 97/30218 | * | 8/1997 |
| WO | WO 98/41686 | | 9/1998 |
| WO | WO 02/12625 | | 2/2002 |

* cited by examiner

*Primary Examiner*—Steven P. Griffin
*Assistant Examiner*—Dennis R. Cordray
(74) *Attorney, Agent, or Firm*—Sheila A. Loggins

(57) ABSTRACT

An internal size and a method for sizing board, such as liquid packaging board, with a hydrophobising internal size containing oxetanon derivative or 2-oxetanon. The main part of the hydrocarbon chains R' and R" of the oxetanon derivative or 2-oxetanon are derived from linear fatty acids, and ≦20 w-%, typically 2 to 15 w-%, most typically 5 to 12 w-% of the hydrocarbon chains are derived from branched and mainly saturated fatty acids.

10 Claims, No Drawings

METHOD IN INTERNAL SIZING OF LIQUID PACKAGING BOARD AND INTERNAL SIZE

This application is a 371 of PCT/Fl02/00302, filed Apr. 10, 2002 and claims priority to Finland Application No. 20010737, filed Apr. 10, 2001.

The present invention relates to a method in internal sizing of liquid packaging board, to an internal size used in making of liquid packaging board, to a liquid packaging board, to a liquid package, and to the use of internal size, defined in the preambles of the independent claims presented below.

With an internal size it is meant a size which is mixed to the fibre suspension of the manufactured product, such as liquid packaging board. The aim of internal sizing in the making of board is generally to increase the durability of the board. The use of hydrophobising sizes, such as alkyl ketene dimer sizes, or AKD sizes, will at the same time increase the hydrophobicity of the board, i.e. the board's durability also in humid conditions is increased. Hydrophobising sizes are thus used for instance in liquid packaging boards.

Good hydrophobicity provides advantages also in the production of packages. The manufacturing conditions are humid, whereby, due to moisture swelling, a board with poor hydrophobicity may change its dimensions so much that the operation of the machines making the packages and filling them will be disturbed.

Usually a liquid packaging board is coated on both sides with different moisture resistant coatings, such as polyethylene. Thus increasing the board's hydrophobicity with the above mentioned internal size may be viewed as a safety precaution regarding the package itself. However, the hydrophobicity of the board may be put to the trial by a possible damage in the coating, or when an incomplete coating is obtained in the manufacturing of the package, due to the production technique or due to a production error, for instance in the region of a seam.

Above mentioned AKD sizes, i.e. sizes based on alkyl ketene dimer containing 2-oxetanon are generally used to increase the hydrophobicity of board, whereby these sizes have been prepared by using linear fatty acids with hydrocarbon chains having a typical length of 14 to 20 carbon atoms. In internal sizing of board these sizes are generally used in amounts, which are about 0.1 to 0.8%, typically about 0.2% of the fibre weight. The AKD size is added as a dispersion to the fibre suspension where the aim is to distribute the size material between the fibres and to attach the size to the fibres. AKD sizes can provide a sufficiently good liquid resistance to the board.

A board strengthened in a conventional manner regarding the hydrophobicity probably answers the needs regarding the durability of liquid and food packages with short circulation time even in the above mentioned exceptional situations. However, problems may occur in packages intended for long-time storage.

Problems may occur particularly in such cases where the uncoated edges of the board material are longer times exposed to liquids, such as the package seam areas will be in certain juice packages or in packages for ultrapasteurised milk. The uncoated seam areas, i.e. the cut edges of the board, will absorb the more liquid the longer the liquid is kept in the package. At the uncoated seams the packed liquid will break the bonds between the internal size and the fibres, whereby the liquid can penetrate still deeper into the board and make the board less durable.

The sterilisation of the package can also become a problem, as it generally is done by hot hydrogen peroxide. The hot hydrogen peroxide is easily absorbed at the cut edges of the package into the board material, whereby it makes the board less durable.

The patent publication U.S. Pat. No. 4,927,496 has proposed to prevent the absorption of hydrogen peroxide into the board by adding to the board stock, in addition to the AKD size, a cationic resin size and some material which prevents dissolution. Another patent publication U.S. Pat. No. 5,456,800 has proposed again to prevent the absorption of hydrogen peroxide by adding to the board stock, in addition to the AKD size, a resin which hardens in a high temperature and which is able to create covalent bonds with the cellulose fibres, and a size which does not react with the cellulose.

In theory it would be possible to prevent the absorption of milk, juice or the like into the board through its cut edges by increasing the amount of the internal size. In the preparation of AKD sizes used in the sizing of board fatty acids with long chains, e.g. stearic acids, are used in order to attain the desired hydrophobicity. Due to the long hydrocarbon chains the AKD sizes require a relatively high operating temperature, and thus it is not preferable to add them in higher amounts to the fibre suspension than those used at present. At low temperatures these sizes are too sticky and will be poorly distributed. In addition, these sizes tend to be deposited on the surfaces of process equipment, which causes runnability problems in the processes.

The long linear hydrocarbon chains in the AKD sizes also present the disadvantage that the maturing, i.e. formation of the bonds between the size and the fibres during the board manufacturing is slow, whereby, in order to secure that the size is matured, it is necessary to keep the otherwise finished board artificially at a high temperature for several hours. Therefore the board cannot, for example, be cut immediately after the board machine, but the board must be stored for some time as rolls, which can retain the heat required for the maturing. This will delay the production and requires storage space for the rolls.

Previously the European patent application EP 98119640 has proposed i.a. for making of paper intended for liquid jet printers, an internal size to be used, the size containing at least 25 percent by weight (w-%) of a 2-oxetanon derivative having a low melting point, i.e. <35° C. In the presented sizes at least one of the hydrocarbon chain groups derived from the fatty acids of 2-oxetanon is a saturated or unsaturated, branched hydrocarbon chain.

However, an internal size containing such unsaturated hydrocarbon chains can not be used for the sizing of liquid packaging boards because they cause taste and smell problems. The unsaturated hydrocarbon chains react easily with the oxygen in the air, in other words they go rancid, whereby they form ill-smelling and -tasting aldehydes. These rancid processes may start already in the making of the board, and continue in favourable conditions, i.e. due to the action of heat and oxygen, e.g. in finished packages. Such smell problems are also carried to elsewhere in the process by the waters in the board machine.

The taste problems caused by the oxidation and carried from the packaging material to the packed material, such as milk, other food or tobacco, can be reduced according to the patent publication U.S. Pat. No. 5,603,997 by adding hydrophobic zeolite to the packaging material. The addition of zeolite can reduce the oxidation. In addition the zeolite improves the effect of the AKD size.

Further, the publication WO 98/41686 has previously proposed to improve the ink absorption characteristics of fine paper intended for multi-colour ink jet printers with the aid of a suitable filler material and an internal size. The publication proposes to use a filler based on calcium carbonate and an internal size which contains 2-oxetanon. The 2-oxetanon used in the internal size is made of one or more, mainly saturated fatty acids having at least one main branch comprising 6 to 22 carbon atoms and at least one branched hydrocarbon chain. This provides an ink absorption which is suitable for both black and white printing, and colour printing.

In the publication WO 97/30218 it is presented a 2-oxetanon multimer suitable for the sizing of fine paper, which multimer is not solid at a temperature of 35° C. In the multimer mixture proposed in the publication at least 25 w-% of the multimers contain irregularities, such as branched alkyl groups or branched or linear alkenyl groups. The proposed 2-oxetanon multimer is used for surface sizing of fine paper.

The object of the present invention is to provide an improvement to the above mentioned problems.

Thus the object is to provide an improved method for internal sizing of liquid packaging board, an improved internal size for liquid packaging board, an improved liquid packaging board and a liquid package made of the board.

A further objective is to provide an internal size which enables an improved runnability at the board machine.

An object is also to provide an internal size due to which the time required to mature the board can be reduced.

A further object is to provide an internal size for liquid packaging board, which size prevents smell and/or taste problems from being created in liquid packaging board and in its manufacturing process, or which at least substantially reduces the creation of these problems.

In order to attain the above mentioned objectives the method according to the invention in internal sizing of liquid packaging board, the improved internal size for liquid packaging board, the internal size and its use, the improved liquid packaging board and a liquid package made of it, are characterised in what is defined in the characterising parts of the independent claims presented below.

A typical internal size according to the invention comprises an oxetanon derivative according to the formula (I), typically a 2-oxetanon according to the formula (II), i.e. an AKD size.

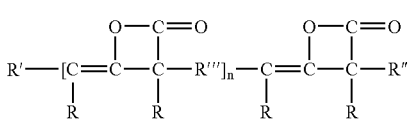

(I)

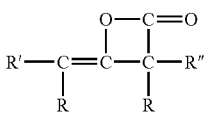

(II)

In the oxetanon derivative according to the formula (I) n is typically 0 to 6. In the formulas (I) and (II) R is hydrogen or a linear hydrocarbon chain, and R', R" and R'" are hydrocarbon chains.

According to the invention the hydrocarbon chains R' and R" of the internal size for the liquid packaging board are

- mainly derived from unbranched linear fatty acids, and
- for ≦20 w-%, typically about 2 to 15 w-%, advantageously 5 to 12 w-%, derived from branched and mainly saturated fatty acids.

Thus in a typical solution according to the invention about 80 to 95% of the hydrocarbon chains R' and R" which are derived from fatty acids are linear and about 5 to 20% of them are branched and mainly saturated.

According to one embodiment of the invention, advantageously 5 to 10 w-%, most preferably about 8 to 10 w-% of the hydrocarbon chains R' and R" are derived from branched and mainly saturated fatty acids.

R'" is a linear or branched alkyl chain or an acyclic alkyl chain having 2 to 40, typically 4 to 12 carbon atoms.

R is hydrogen or a linear hydrocarbon chain having typically 1 to 6 carbon atoms, most typically 1 to 2 carbon atoms. Preferably R is hydrogen.

AKD or alkyl ketene dimer is a typical 2-oxetanon which can be used in the internal size composition in the manner intended by the invention. Then in a part of the AKD size at least one of the AKD's two hydrocarbon chains R' and R" can be branched. The main part of both the linear and branched hydrocarbon chains is saturated. However, as fatty acids already naturally contain unsaturated hydrocarbon chains, the AKD size generally always contains some amount of unsaturated hydrocarbon chains derived from these unsaturated fatty acids, if the size is not specially treated in order to remove double bonds. Typically at most 1.5% of the hydrocarbon chains R' and R" in the internal size are derived from unsaturated fatty acids.

Thus in a typical internal size according to the invention, the hydrocarbon chains R' and R" are

- mainly derived from linear, mainly saturated fatty acids having typically 12 to 22, most typically 16 to 18 carbon atoms, and
- for a small part derived from branched, mainly saturated fatty acids, where the length of the hydrocarbon chain is typically 12 to 22, more typically 16 to 18, most typically 18 carbon atoms.

When in the solution according to the invention ≦20 w-%, preferably 2 to 15 w-%, most advantageously 5 to 12 w-% of the total amount of the hydrocarbon chains R' and R" are derived from branched and mainly saturated fatty acids, then in the internal size

- both a part of the hydrocarbon chains R' and a part of the hydrocarbon chains R" can be derived from branched fatty acids, or
- a part or all hydrocarbon chains R' can be derived from branched fatty acids, whereas all hydrocarbon chains R" are derived from linear fatty acids, or
- a part or all hydrocarbon chains R" can be derived from branched fatty acids, whereas all hydrocarbon chains R' are derived from linear fatty acids.

In a solution according to the invention the internal size can contain oxetanon derivatives or 2-oxetanons according to formulas (I) or (II), whereby the branched hydrocarbon chains R' and R" of these can be derived from the same fatty acid or from two or more different fatty acids. Typically R' and R" are derived from the same fatty acid. Typically the main part of both the linear and the branched hydrocarbon chains are derived from fatty acids where the length of the hydrocarbon chain is 12 to 22 carbon atoms, more typically 16 to 18 carbon atoms.

The internal size according to the invention is added to the fibre suspension used for the making of board, generally at most 1%, typically about 0.1 to 0.8%, most typically <0.4% of the fibre weight. In addition to the internal size according to the invention also one or more other internal sizes known as such can be added to the board, such as hydrophobising size, resin size, polymer size or ASA size or other corresponding size, for instance to reduce the board's absorption of lactic acid or peroxide and/or to increase the dry strength and/or the wet strength, or when some other property so requires.

Due to the branched hydrocarbon chains contained in the internal size according to the invention with this internal size it will be attained in the same conditions certain essential advantages compared to a conventional internal size. We can for instance mention the following advantages of the internal size according to the invention containing branched hydrocarbon chains:

- at the operating temperature of the board machine the internal size will not adhere as easily to the surfaces of the machine as a corresponding conventional AKD internal size, which contains only linear hydrocarbon chains, whereby the runnability of the board machine is improved by applying the solution according to the invention;
- the internal size is well distributed already at the operating temperature of the board machine, whereby the efficiency of the internal sizing increases compared to conventional internal sizing; and
- the internal size matures or reacts with the fibres faster than a conventional internal size, whereby it is generally possible to reduce the storage time.

As an important advantage of the internal size according to the invention we can also consider the fact that in order to attain the above mentioned advantages it is not necessary for the internal size to contain more than the natural amount of unsaturated hydrocarbon chains, which in other words can become rancid. Thus we avoid the problems concerning smell and taste which are created if we would try to reach the above mentioned advantages regarding the adherence, distribution and maturing by using unsaturated fatty acids in the making of the AKD.

As an additional advantage of the internal size according to the invention, compared to a conventional AKD internal size containing linear hydrocarbon chains, we can further mention the advantageous effect of the internal size according to the invention on the friction of the board's surface. An internal size containing branched hydrocarbon chains increases the friction of the board's surface, whereby it is easier than previously to coat the surface with plastic, such as polyethylene.

The following example illustrates the effects which can be provided by the internal size according to the invention. As the internal size we used an AKD dispersion where the AKD was made of branched and linear (C18) fatty acids mixed in different proportions. As a protective colloid we used starch (21.6% of the amount of internal size). As a reference we used internal size which was made without using branched fatty acids.

Board (200 g/m$^2$) was made in a sheet mould in the laboratory. As pulp composition we used a cellulose pulp of 60% birch and 40% pine cellulose pulp. The pH of the pulp suspension was adjusted by adding 1% sodium bicarbonate. 0.8% pulp starch was added to the cellulose suspension. The AKD dispersion was added in the amounts of 0.1% and 0.2%.

The hydrophobic degree of the paper was determined by $Cobb_{120}$ measurements, and by edge absorption tests typical for liquid packaging boards, lactic acid REP and $H_2O_2$ REP. The $Cobb_{120}$ values were determined immediately when the paper sheet had dried, and after one week of maturing. The REP values and the friction were determined after one week of maturing.

From the table 1 we can conclude that the size will mature faster when the amount of branched hydrocarbon chains increases in the internal size. This is shown by the $Cobb_{120}$ values, or by the hydrophobicity degree, whose difference between the "not matured" and "matured" board decreases as branched hydrocarbon chains are added to the internal size.

The edge absorption test shows that the lactic acid resistance is slightly reduced, not substantially however, and the peroxide resistance increases, as the amount of branched hydrocarbon chains increases. The friction of the board is also improved and it is easier to coat the board as the amount of hydrocarbon chains derived from branched fatty acids increases.

Thus the internal size according to the invention, which improves the runnability of the board machine and accelerates the maturing of the size, will provide a relatively good sizing despite the increased amount of branched hydrocarbon chains, even when we did not use in these tests other hydrophobic sizes, such as resin or ASA size, which are usually used together with AKD size.

TABLE 1

| Composition of the AKD wax in the dispersion | $Cobb_{120}$ (g/m$^2$) | | REP | | | Friction | |
|---|---|---|---|---|---|---|---|
| | | | Lactic acid | | $H_2O_2$ 10 min/ | | |
| Branched/ Linear | No maturing | 1 week maturing | 1 h/23° C. (kg/m$^2$) | 24 h/23° C. (kg/m$^2$) | 70° C. (kg/m$^2$) | Static | Motion |
| Addition 0.1% | | | | | | | |
| 0/100 | 39.8 | 34.8 | 0.51 | 1.91 | 3.82 | | |
| 2.5/97.5 | 37.6 | 33.2 | 0.53 | 2.12 | 3.80 | | |
| 5/95 | 34.9 | 32.9 | 0.54 | 2.24 | 3.73 | | |
| 10/90 | 34.4 | 32.7 | 0.55 | 2.30 | 3.28 | | |
| 15/85 | 32.1 | 30.5 | 0.56 | 2.34 | 3.24 | | |
| 20/80 | 34.0 | 33.1 | 0.58 | 2.47 | 3.10 | | |
| 25/75 | 34.8 | 33.5 | 0.63 | 2.60 | 2.82 | | |
| 50/50 | 36.5 | 35.5 | 0.75 | 2.95 | 2.80 | | |
| 70 linear/ 30 unsaturated | 35.7 | 34.5 | 0.74 | 2.80 | 2.91 | | |

TABLE 1-continued

| Composition of the AKD wax in the dispersion Branched/Linear | Cobb$_{120}$ (g/m$^2$) No maturing | Cobb$_{120}$ (g/m$^2$) 1 week maturing | REP Lactic acid 1 h/23° C. (kg/m$^2$) | REP Lactic acid 24 h/23° C. (kg/m$^2$) | REP $H_2O_2$ 10 min/70° C. (kg/m$^2$) | Friction Static | Friction Motion |
|---|---|---|---|---|---|---|---|
| Addition 0.2% | | | | | | | |
| 0/100 | 37.0 | 32.2 | 0.40 | 1.60 | 3.39 | 0.3 | 0.39 |
| 2.5/97.5 | 33.5 | 31.0 | 0.41 | 1.63 | 3.23 | | |
| 5/95 | 33.2 | 32.1 | 0.42 | 1.67 | 2.70 | | |
| 10/90 | 31.5 | 30.6 | 0.44 | 1.72 | 2.70 | | |
| 15/85 | 30.6 | 29.7 | 0.45 | 1.74 | 2.61 | | |
| 20/80 | 28.8 | 28.0 | 0.48 | 1.85 | 2.60 | | |
| 25/75 | 31.0 | 29.7 | 0.55 | 1.97 | 2.55 | 0.36 | 0.51 |
| 50/50 | 32.0 | 30.8 | 0.65 | 2.25 | 2.50 | | |
| 70 linear/30 unsaturated | 31.5 | 30.6 | 0.62 | 2.20 | 2.70 | | |

In the same conditions the internal size according to the invention reaches mainly the same sizing effects and the same hydrophobicity as a conventional AKD size.

The table 1 also shows that when the amount of hydrocarbon chains derived from branched fatty acids is about 10 w-% in the internal size, then the characteristics of the board sized with said internal size are clearly improved. For instance the board's $H_2O_2$ REP value is considerably improved when the amount of the branched hydrocarbon chains in the internal size increases from 5 w-% to 10 w-%. At the same time the lactic acid REP values and the Cobb$_{120}$ values of the board remain relatively constant. Thus from the table 1 it can be concluded that the characteristics of the board are improved on the average when the amount of branched hydrocarbon chains in the internal size is ≦20 w-%.

The adhesion of the internal size according to the invention was separately tested in the laboratory with a UCM Deposit rotor, which has been presented in the international publication PCT/ES98/00029.

The internal sizes were diluted with water to a dry solid contents of 0.1%, and then tared foils were immersed in the internal size and left to rotate (250 rpm) in the solution for 1 hour at 60° C. After one hour the foils were immersed in clean water, dried and weighted.

TABLE 2

| Sample Branched/linear | Stickies mg/m$^2$ |
|---|---|
| 0/100 | 59 |
| 2.5/97.5 | 47 |
| 5/95 | 41 |
| 10/90 | 40 |
| 15/85 | 39 |
| 20/80 | 36 |
| 25/75 | 35 |
| 50/50 | 33 |
| 30 unsaturated/70 linear | 53 |

The test results presented in table 2 show that by increasing the amount of hydrocarbon chains derived from branched fatty acid chains in the AKD size it is possible to reduce the amount of stickies. Thus it is possible to improve the runnability of the board machine, as the size according to the invention will not adhere as easily to the board machine's structures as prior corresponding sizes.

The smell and taste compounds of the AKD size were analysed by Headspace-GC/MS techniques. 2 g of AKD dispersion +0.1 mg of 4-heptanon (ISTD) were weighted into the headspace bottle. The bottle was filled with nitrogen before closing it. The sample was heated for 30 minutes at 90° C., and then the generated gas phase was analysed with GC/MS.

TABLE 3

| Sample Branched/linear | Smell and taste compounds µg/g |
|---|---|
| 0/100 | ND |
| 2.5/97.5 | ND |
| 5/95 | ND |
| 10/90 | ND |
| 15/85 | ND |
| 20/80 | ND |
| 25/75 | ND |
| 50/50 | ND |
| 30 unsaturated/70 linear | 0.1 |

The results presented in table 3, ND (not detected), show that the AKD internal size according to the invention containing hydrocarbon chains derived from branched fatty acids do not create any smell or taste disadvantages. On the other hand, an AKD internal size containing larger amounts of unsaturated hydrocarbon chains may cause both smell and taste problems.

The invention is not supposed to be restricted to the above embodiments presented as examples, but the aim is to be able to apply the invention broadly within the scope defined by the enclosed claims.

What is claimed is:

1. A method for sizing board by adding to a fiber suspension for board a hydrophobising internal size containing an oxetanone derivative according to the formula (I)

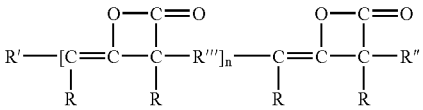

(I)

or a 2-oxetanone according to the formula (II)

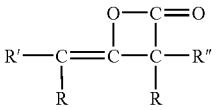

(II)

wherein n is 0 to 6,

R is hydrogen or a linear hydrocarbon chain, and R', R" and R'" are hydrocarbon chains, hydrocarbon chains R' and R" are derived from linear and branched fatty acids and 2 to 10 wt. % are derived from branched and saturated fatty acids and a maximum of 1.5 wt. % of the hydrocarbon chains R' and R" are derived from unsaturated fatty acids.

2. The method of claim 1, wherein 5 to 10 wt. % of the hydrocarbon chains R' and R" are derived from branched fatty acids.

3. The method of claim 1, wherein the hydrocarbon chains R' and R" derived from linear fatty acids are fatty acids having 12 to 22 carbon atoms.

4. The method of claim 1, wherein the hydrocarbon chains R' and R" are derived from branched fatty acids having 12 to 22 carbon atoms.

5. The method of claim 1, wherein the hydrocarbon chain R'" is a linear or branched alkyl chain or an acyclic alkyl chain having 2 to 40 carbon atoms.

6. The method of claim 1, wherein the internal size is added to a fibre suspension used for the making of board in an amount of at most 1 wt. % of the fibre weight.

7. The method of claim 1, further comprising adding one or more internal sizes to the internal size in order to reduce the board's absorption of lactic acid or peroxide.

8. A method of improving board machine runnability by adding to the fiber suspension of the board an internal size containing an oxetanone derivative according to the formula (I)

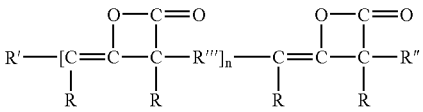

(I)

or a 2-oxetanone according to the formula (II)

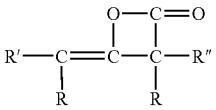

(II)

wherein n is 0 to 6,

R is hydrogen or a linear hydrocarbon chain, and R', R" and R'" are hydrocarbon chains, wherein the hydrocarbon chains R' and R" are derived from linear or branched fatty acids, and 2 to 10 wt. % are derived from branched and fatty acids and a maximum of 1.5 wt. % of the hydrocarbon chains R' and R" are derived from unsaturated fatty acids.

9. A method for manufacturing a board for food stuff packages, comprising adding an internal size containing an oxetanone derivative according to the formula (I)

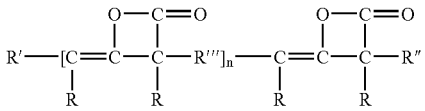

(I)

or a 2-oxetanone according to the formula (II)

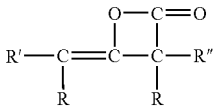

(II)

wherein n is 0 to 6,

R is hydrogen or a linear hydrocarbon chain and R', R" and R'" are hydrocarbon chains, wherein the hydrocarbon chains R' and R" are derived from linear or branched fatty acids, and 2 to 10 wt. % are derived from branched and fatty acids and a maximum of 1.5 wt. % of the hydrocarbon chains R' and R" are derived from unsaturated fat acids to a fibre suspension suitable for manufacture of the board, in an amount of at most 1% of the fibre weight.

10. A method of sizing board by adding to a fiber suspension for board a hydrophobising internal size containing an oxetanone derivative according to the formula (I)

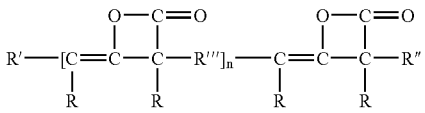

(I)

or a 2-oxetanone according to the formula (II)

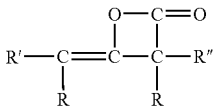

(II)

wherein n is 0 to 6,

R is hydrogen or a linear hydrocarbon chain, and R', R" and R'" are hydrocarbon chains, wherein R' and R" are derived from 2 to 10 wt. % branched fatty acids and ≧90 wt. % are derived from linear fatty acids and a maximum of 1.5 wt. % are derived from unsaturated fatty acids.

* * * * *